United States Patent [19]

Schneider

[11] 3,973,690

[45] Aug. 10, 1976

[54] SEALING CLOSURE CAP ASSEMBLY

[75] Inventor: Barry L. Schneider, Crystal Lake, Ill.

[73] Assignee: Chemtrust Industries Corporation, Franklin Park, Ill.

[22] Filed: June 3, 1974

[21] Appl. No.: 475,383

[52] U.S. Cl. ..... 215/329; 215/346; 215/350

[51] Int. Cl.[2] ..... B65D 41/04

[58] Field of Search ..... 215/329, 346, 350, 352

[56] References Cited

UNITED STATES PATENTS

| | | | |
|---|---|---|---|
| 2,670,869 | 3/1954 | Martin | 215/329 |
| 3,331,523 | 7/1967 | Exton | 215/350 |

FOREIGN PATENTS OR APPLICATIONS

| | | | |
|---|---|---|---|
| 547,660 | 5/1956 | Belgium | 215/350 |
| 1,488,433 | 6/1967 | France | 215/329 |

*Primary Examiner*—Donald F. Norton

*Attorney, Agent, or Firm*—Wallenstein, Spangenberg, Hattis & Strampel

[57] ABSTRACT

A sealing closure assembly for a container mouth including a closure cap and a sealing member having a sealing portion which sealingly engages with a releasable locking fit with the mouth of said container and a cap engaging portion slidably engageable by an axially outwardly facing shoulder of the closure cap. The sealing portion of said sealing member remains in place in sealing relation to the closure mouth for a portion of the rotation of said closure cap means when the same is rotated in a direction to unthread the same from the external screw thread means of the container and is forced from sealing and locking engagement with the container mouth by the shoulder of the closure cap solely by the force created by the further unthreading of the closure cap means from said external screw thread means of the closure cap means.

14 Claims, 8 Drawing Figures

FIG. 1
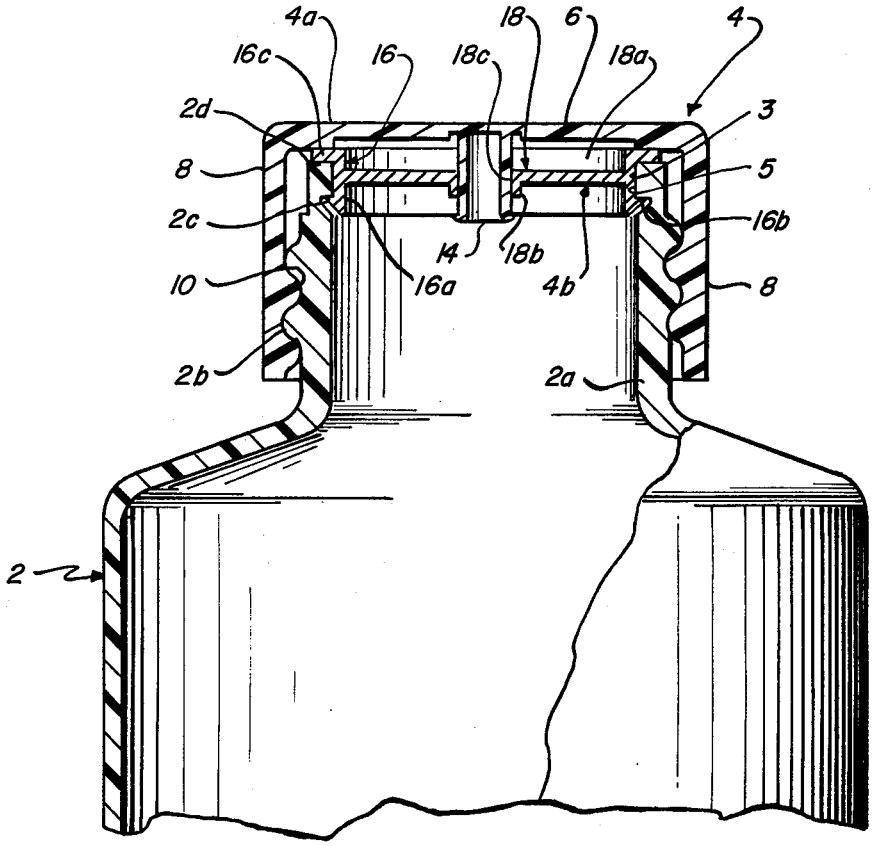
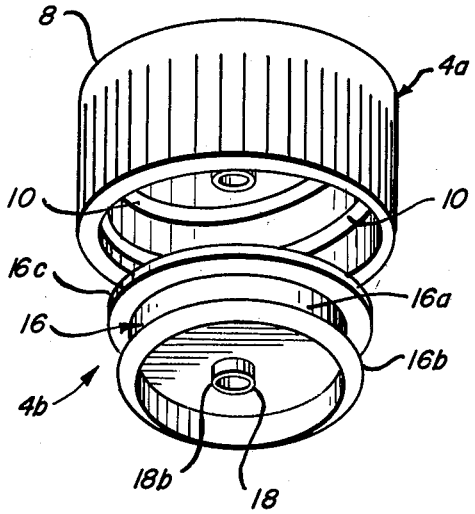
FIG. 2
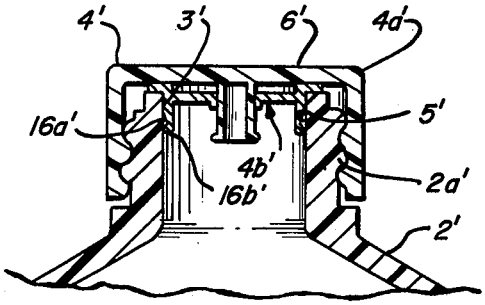
FIG. 8

SEALING CLOSURE CAP ASSEMBLY

BACKGROUND OF THE INVENTION

This invention relates to closure caps for sealing the mouths of bottles and other containers. It has particular application to the sealing of bottles and other containers against the leakage or spillage of liquid materials during the shipping thereof where vibration frequently causes the closure caps to loosen, and also in the process of removing the closure cap from the mouth of the container involved.

It is especially important to prevent spillage of corrosive materials which can cause damage to the user or to metal or other surfaces upon which such materials may drip during undesired leakage from the container involved. It has been, therefore, proposed to place a secondary seal over the mouths of containers carrying such corrosive materials beneath the usual closure cap which sealingly interlocks with the neck portions of the containers involved when tightened thereon. In such case, the loosening of the closure cap during shipment will not destroy the secondary seal which must be separately removed to gain access to the contents of the container. To remove such a secondary seal, however, adds a hazard to the user or the equipment which may be utilized to severe or pry loose the secondary seal. For example, if the secondary seal is severable diaphragm and it is punctured by a screwdriver or other tool, the portion of the tool which enters the mouth of the container can contact the corrosive material therein and be damaged thereby. In those cases where the secondary seal is a plug or the like which must be manually pried loose from the container, in the process of pulling the sealing member from the container the bottle is often violently shaken resulting in spillage of the container contents onto the user's skin or clothing.

There have been heretofore developed a closure cap and sealing member assembly where, initially at least, the closure cap carries a sealing member, and in the process of securing the closure cap in place the sealing member is automatically pressed into a sealing position within the container mouth involved. In one form of such a closure cap and sealing member assembly, the sealing member is separated or severed from the closure cap when the closure cap is tightened on the container mouth. Such a closure cap and sealing member assembly is disclosed in U.S. Pat. No. 3,425,579 to M. Braun et al. In another form of closure cap and sealing member assembly, the sealing member is finally removed from the container mouth after complete release of the closure cap by pulling on the closure cap to apply sufficient outward force to release the sealing member. Such a closure cap assembly is disclosed in U.S. Pat. No. 3,753,510 which utilizes a bayonet joint interconnection between the closure cap and the container mouth. Both of these closure cap and sealing member assemblies require a substantial separating force when there is a tight fit between the sealing member and container mouth, and the container can be violently shaken during release of the sealing member, causing spillage of the container contents. Also, in the case of the bayonet joint type closure cap, it requires special closure applying equipment to mount the same.

Accordingly, one of the objects of the invention is to provide a sealing closure cap assembly which includes a closure cap which interlocks with the exterior of the mouth of the container involved and which further carries a sealing member which remains in tight sealing relation to the mouth of the bottle at least during initial release of the closure cap, and wherein the sealing member can be released from the mouth of the bottle with a modest force applied in such a way that the bottle will not shake during the release thereof.

A further object of the invention is to provide a closure cap and sealing member assembly as described which can be made at a minimum cost in comparison to more complicated and less effective sealing closure cap assemblies heretofore developed.

Another object of the invention is to provide a closure cap and sealing member assembly as described which can be applied with conventional bottle cap applying equipment.

SUMMARY OF THE INVENTION

The sealing closure cap assembly of the present invention involves a marked improvement over the sealing closure cap assemblies heretofore developed, among other reasons, in that the sealing member can, if desired, make a very tight fit with the mouth of the container and yet only a very modest twisting force rather than a substantial pulling force is required of the user to release the sealing member from the mouth of the container, thereby preventing the violent shaking of the bottle and spillage of the contents thereof during the process of removing a tightly fitting sealing member from the container mouth. In the most advantageous form of the invention, this is achieved in a very simple and inexpensive manner with a closure cap preferably having a conventional cylindrical skirt with internal threads adapted to make threaded engagement with the external threads of the mouth of the container, and a sealing member supported on the inside of the end wall of the closure cap so the closure cap is axially and rotatably movable with respect to the sealing member. The sealing member has a sealing portion at the periphery thereof which engages the container mouth with a releasable locking fit preferably providing an air and liquid tight seal over the mouth of the container automatically when the closure cap is initially threaded onto the container. The sealing member further has a central mouth covering and cap engaging portion engageable by an axially outwardly facing shoulder preferably formed by an extension of the end wall of the closure cap. The closure cap end wall extension preferably interfits with the sealing member so as to form a friction sliding fit therewith so that if there should be a back-off of the closure cap resulting from vibration forces occurring during shipment thereof, this will not destroy the air and liquid tight seal over the container mouth. The peripheral sealing portion of the sealing member remains in stationary sealing relation to the container mouth during at least part of one turn of the closure cap when rotated in a direction to unthread the same from the container. After the loosening of the closure cap, the axially outwardly facing shoulder of the closure cap end wall extension applies sufficient outward force to the sealing member to release the same from sealing and locking engagement with the container mouth. A mechanical advantage is achieved by virtue of the inclined plane action of the engaging screw threads which enables a modest twisting force on the closure cap to develope the substantial axial force necessary to release a tight fitting sealing member from the container mouth. Thus, the sealing member is released from the container mouth without any shaking of the container or spillage of the contents thereof.

The sealing member can be a very inexpensive synthetic plastic molded part which slips over the end of a projection depending from the end wall of the closure cap, which is then turned outwardly to form a rivet-like termination holding the sealing member in place on the closure cap.

It is thus apparent that the closure cap of the invention is not only a means for automatically applying an inexpensively constructed sealing member to the container mouth when it is applied thereover, but, more importantly, it is also a means for removing the sealing member therefrom with a modest twisting force as described. Also, in the preferred embodiment thereof. it can be applied with conventional bottle cap applying-type equipment. Additionally, when the closure cap is tightly mounted in place, it is preferred that the end wall of the closure cap press against a flanged portion of the sealing member extending over the edge of the container mouth, to reinforce the air and liquid tight seal at this point of the closure assembly.

DESCRIPTION OF THE DRAWINGS

FIG. 1 is a fragmentary vertical sectional view through the top of a bottle having applied thereto the preferred form of sealing closure assembly of the present invention;

FIG. 2 is an exploded view, partly broken away, of the two parts making up the preferred form of sealing closure assembly of the invention;

FIG. 8 is an enlarged vertical sectional view through a modified form of sealing closure assembly where the sealing member thereof is modified from that shown of the sealing member of the embodiment of the invention shown in FIGS. 1–7.

DESCRIPTION OF THE PREFERRED EMBODIMENT OF THE INVENTION

Figure 3:
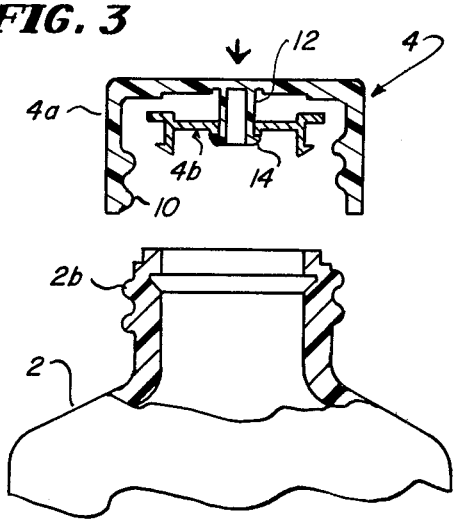
FIG. 3 and 4 depict, in sequence, the mounting of the sealing closure assembly of the present invention upon the neck of the bottle of FIG. 1.

Referring now to FIGS. 1 and 2 in particular, a sealing closure assembly 4 incorporating unique design features to be described is shown mounted upon a more or less conventional shaped bottle 2 having a cylindrical neck 2*a* defining a discharge mouth 3 into the interior of the bottle and having on the exterior thereof the usual threading 2*b* for receiving a conventional threaded bottle cap. The sealing closure assembly 4 includes a closure cap 4*a* and a sealing member 4*b* the details of which will shortly be described. The bottle 2 can contain any suitable material to be poured from the mouth of the bottle including strong corrosive materials which present a special problem for the proper sealing thereof.

While a sealing closure assembly incorporating various unique features of the present invention is useable as a sealing means for container mouths of various designs, the most preferred form of sealing closure assembly 4 as illustrated is designed to be applied to a container neck having the conventional type threading

2*b*. To this end, the closure cap 4*a* is preferably made of a corrosion-resistant synthetic plastic material and has the general configuration of a conventional bottle cap including a circular end wall 6 from the perimeter of which extends a cylindrical skirt or side wall 8 having internal threading 10 for interfitting with the external threading 2*b* of the bottle neck 2*a*. However, the closure cap 4 differs from a conventional bottle cap in that it has depending from the central portion of the inner surface of the end wall 6 a cylindrical extension 12 terminating in an outwardly extending flange portion 14 for the purposes to be explained. The flange 14 at the end of the cylindrical extension 12 of the closure cap end wall 6 prevents the sealing member from being separated from the closure cap, and acts as a force supplying means in a manner to be described to effect removal of the sealing member 4*b* from the mouth of the bottle neck 2*a*.

The sealing member 4*b*, which is preferably made of a resilient synthetic plastic material has a peripheral sealing portion 16 including a cylindrical section 16*a* sized to extend along the inner cylindrical surface 5 of the bottle neck 2*a* and terminating at the bottom end thereof in outwardly projecting and downwardly tapering resilient locking section 16*b* adapted to be snap-fitted in an undercut portion 2*c* on the inner surface 6 of the bottle neck. The cylindrical section 16*a* of the sealing member terminates at its upper or outer end in an outwardly extending flange 16*c* which, when the locking section 16*b* thereof is snap-fitted within the undercut portion 2*c* of the bottle neck, is drawn into snug air and liquid tight sealing engagement with the outer edge 2*d* of the bottle neck.

The sealing member 4*b* has a central mouth covering and closure cap engaging portion 18 comprising preferably a flexible circular wall 18*a* extending radially inwardly from the cylindrical section 16*a* of the sealing member and terminating at its inner end in a thickened hub portion 18*b* defining a cylindrical aperture 18*c* passing through the circular wall 18*a*. The defining walls of the aperture 18*c* make a sliding air and liquid tight fit over the preferably somewhat longer cylindrical extension 12 of the end wall 6 of the closure cap 4*a*. The slide fit between the closure cap end wall extension 12 and the sealing member central wall aperture 18*c* permits the closure cap 4*a* to be rotated while the sealing member 4*b* remains in a stationary position over and in the bottle mouth. Also, in the preferred form of the invention, both the resiliency of the circular wall 18*a* of the sealing member and the somewhat shorter axial length of the hub portion 18*b* of the sealing member relative to the length of the cylindrical extension 12 of the closure cap end wall permits limited relative axial movement between the closure cap and the sealing member.

Figure 4:
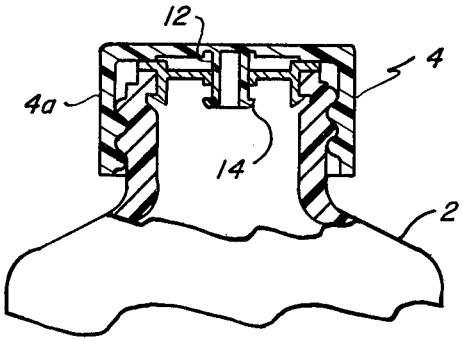

As the closure cap 4*a* is threaded upon the bottle neck, the end wall 6 thereof presses upon the flange 16*c* of the sealing member and pushes the rest of the sealing member into the bottle neck where the locking section 16*b* thereof snaps into the undercut portion 2*c* on the interior of the bottle neck (see FIGS. 3–4). When the closure cap is tightened on the bottle neck, the end wall 6 presses the flange 16*c* of the sealing member against the outer edge of the bottle neck to reinforce the air and liquid seal thereat and/or sealing member already desirably provided (except where bottle tolerances are such as to prevent such a seal by the drawing force created by the interlocking engagement of the locking section 16b of the sealing member with the undercut portion 2c of the bottle neck). As previously indicated, there is also provided an air and liquid tight seal at the interface between the cylindrical extension 12 of the end wall of the closure cap and the aperture formed by the hub portion 18b of the sealing member.

Figure 5:
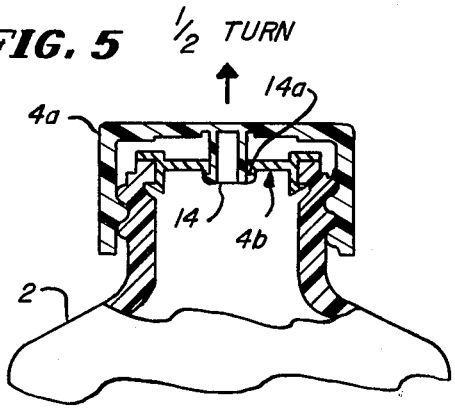
FIGS. 5, 6 and 7 depict, in sequence, the different parts of the sealing closure assembly of the invention in the process of removing the same from the neck of the bottle respectively after one half turn, one turn, and one and one quarter turns of the closure cap portion of the assembly illustrated in FIGS. 1.
Figure 6:
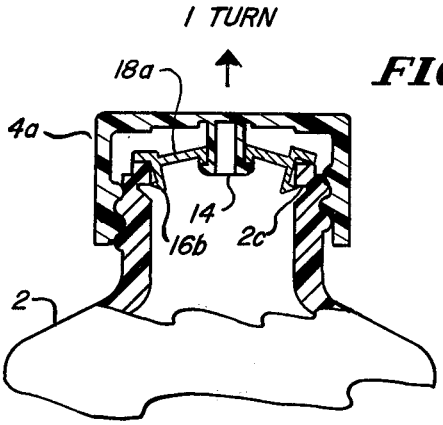
Figure 7:
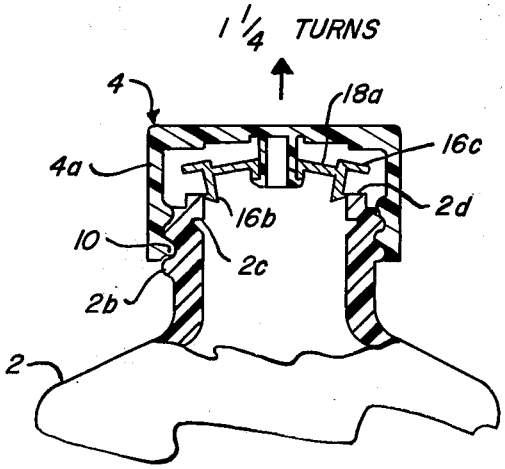

As illustrated in FIGS. 5–7, in the particular embodiment of the invention illustrated in the drawings, it takes about a full turn of the closure cap 4a in an unthreading direction before the upwardly axially facing shoulder 44a of the flange portion 14 of the closure cap end wall extension 12 engages the bottom of the hub portion 18b of the sealing member with sufficient force to cause the locking portion 16b of the sealing member to be sprung from the undercut portion 2c of the bottle neck mouth. It takes approximately another one-quarter turn of the closure cap before the sealing member is completely pulled from within the bottle neck. Thus, if during shipment of the bottle 2 vibrations applied to the bottle are sufficient to cause loosening of the closure cap 4a, such loosening will not result in the release of the sealing member from the sealing position within the bottle neck mouth. It is furthermore of special importance to the present invention that the flange portion 14 of the closure cap end wall extension 12 reaches a position which springs the sealing member from interlocking contact with the bottle mouth before the closure cap has been released from the bottle neck mouth since, in such case, the mechanical advantage of the inclined plane action of the inter-engaging threads 10 and 2b make it possible to force a tightly held sealing member from a locked position with the bottle mouth with a modest twisting force applied to the closure cap.

The present invention is also applicable to container designs wherein the interior surface of the threaded neck thereof does not include an undercut portion 2c as shown in FIG. 1. Reference should now be made to FIG. 8 for this form of the invention which has a sealing closure assembly 4' which in most respects is identical to the sealing closure assembly 4 of FIGS. 1–7 and so corresponding elements thereof have been similarly numbered except a prime (') has been added to the reference numbers of the sealing closure assembly 4'. As there shown, the modified bottle 2' has a bottle neck 2a' with a smooth inner surface 5'. In such case, a releasable locking fit is made between the cylindrical section 16a' of the sealing member 4b' and the defining walls of the bottle neck mouth 3' by the outward resilient expansion of a beaded bottom end portion 16b' of the cylindrical section 16a' of the sealing member. The force of the beaded portion 16b' of the sealing member against the defining walls of the bottle neck interior surface 5' are overcome when the closure cap 4a' has been partially unthreaded from the bottle neck.

It should be understood that numerous modifications may be made in the most preferred form of the invention described, without deviating from the broader aspects of the same.

I claim:

1. A sealing closure assembly for a container having a discharge mouth with external screw thread means surrounding said mouth; said sealing closure assembly comprising: closure cap means having an end wall from the perimeter portion of which extends a cylindrical side wall with internal threads for releasably interlocking with said container external screw thread means, rotation of the closure cap means in one direction or the other relative thereto respectively effecting axis inward or outward movement thereof relative to the container mouth, and a sealing member supported on the inside of the end wall of the closure cap means so the closure cap means is axially and rotatably movable with respect to the sealing member, the sealing member having a sealing portion which sealing portion engages the mouth of said container and makes a releasable locking fit therewith when said cap means is threaded onto the container, said closure cap means having sealing member engaging means engaging said sealing member so said closure cap means is permanently and continuously mounted with respect thereto when the sealing member is in locking engagement with the container mouth; said sealing member engaging means having radially projecting means forming axially outwardly facing shoulder means slidably engageable with a pre-formed permanently inwardly facing portion of said sealing member so unthreading said closure cap means ultimately slidably engages and exerts an outward, releasing force on said releasably locked sealing member, said sealing member releasably interlocking with said container mouth with a force so it remains in place in sealing relation to the closure mouth when said closure cap means is intially unthreaded from the container but is forced loose from sealing and locking engagement with said container mouth by the said shoulder means of the closure cap means solely by the force created by the further unthreading of the closure cap means from said external screw thread means of the container.

2. The sealing closure assembly of claim 1 wherein said sealing member engaging means of said cap means is mounted for limited relatively free axial as well as rotatable movement with respect to said sealing member, wherein said axially inwardly facing portion of said sealing member is not engaged by said axially outwardly facing shoulder means of the sealing member engaging means until the cap means has been partially unthreaded from the container mouth.

3. The sealing closure assembly of claim 1 wherein said sealing portion of said sealing member is at the periphery of said sealing member where it has a radially outwardly projecting section which is shaped and positioned to overlap the outer edge of the container mouth and an axially extending section which is positioned to extend within the container mouth and makes releasable locking engagement with the defining walls thereof in a manner which draws said radially outwardly projecting section of the sealing member into air and liquid tight sealing relation with the outer edge of the container mouth.

4. The sealing closure assembly of claim 3 wherein the end wall of said cap means when fully threaded upon the container is adapted to press upon and make air and liquid tight sealing contact with said outwardly projecting section of the portion of the sealing member.

5. The sealing closure assembly of claim 4 wherein said sealing member has a central container mouth covering portion with an aperture therein, said sealing member engaging means including axially projecting means on the inside of said end wall which passes through said aperture with an air and liquid tight sliding sealing fit and terminates in said radially projecting means forming said axially outwardly facing shoulder means which engages and releases the sealing member from the container mouth when the closure cap means is in the process of being unthreaded from the container.

6. The sealing closure assembly of claim 5 wherein the central container mouth covering portion of said sealing member is a relatively thin wall which resiliently deflects axially outwardly to a limited degree when said shoulder means of said cap means engages and pulls the same axially outwardly as the cap means is in the process of being unthreaded from the external thread means of the container.

7. The sealing closure assembly of claim 3 wherein the axially extending section at the periphery of said sealing member is resiliently flexible and has a container mouth engaging portion adapted to make releasable friction locking engagement with the inner surface of the mouth of the container.

8. The sealing closure assembly of claim 3 wherein said axially extending section at the periphery of the sealing member is resilient and includes outwardly projecting means adapted to snap into an undercut portion provided in the inner surface of the container mouth releasably to hold the sealing member in place.

9. In combination, a container having a discharge mouth with external screw thread means surrounding the same, and a sealing closure assembly for said mouth, said sealing closure assembly comprising closure cap means having an end wall from the perimeter portion of which extends a cylindrical wall with means which relatively interlocks with said container external screw thread means so rotating the closure cap means in one direction or the other relative to the container mouth, and a sealing member within the closure cap means and having a sealing portion which sealingly engages with a releasable locking fit the mouth of said container and a pre-formed permanent inwardly facing cap engaging portion slidably engageable by a permanent axially outwardly facing shoulder means of the closure cap means, said sealing portion of said sealing member remaining in place in sealing relation to the closure mouth for a portion of the rotation of said closure cap means when the same is rotated in a direction to release the same from the external screw thread means of the container and being forced from sealing and locking engagement with said container mouth by said shoulder means of the closure cap means which initially slidably enages said pre-formed inwardly facing cup engaging portion of said sealing member and solely by the force created by the further unthreading of the closure cap means from said external screw threaded means of the closure cap means.

10. The combination of claim 9 wherein said sealing portion of said sealing member is at the periphery of said sealing member wherein it has a radially outwardly projecting section which overlaps and seals against the outer edge of the container mouth and an axially extending section which extends within the container mouth and makes releasable locking engagement with the defining walls thereof to draw said radially projecting section of the sealing member into sealing relation with the outer edge of the container mouth, the end wall of said cap means when fully tightened upon the container pressing on and make sealing contact with said outwardly projecting section of the sealing member, said sealing member having a central closure-forming section which closes off the interior of the container mouth when the closure cap assembly is applied to the container, said central closure-forming section of said sealing member having an aperture the defining walls of which constitutes said cap engaging portion of the sealing member, said cap means having inwardly axially projecting means on the inside of said end wall which passes into said aperture in the central closure-forming section of said sealing member and terminates in outwardly extending portions forming said axially outwardly facing shoulder means.

11. The combination of claim 10 wherein the inner surface of the container mouth has locking groove means, and said axially extending section of the sealing member which lockingly fits within the container mouth is resilient and includes outwardly projecting means snap-fitted in said locking groove means provided in said container to draw the outwardly projecting portion of the sealing member overlapping the outer edge of the container mouth into sealing engagement therewith.

12. The combination of claim 10 wherein said radially outwardly projecting section of said sealing member is sealingly engaged by the end wall of the closure cap means when said cap means is tightened on the container.

13. The combination of claim 10 wherein said inwardly axially projecting means on the inside of said end wall passes through said aperture in the central mouth closing section of said sealing member with a sliding seal-forming fit.

14. The combination of claim 9 wherein said axially outwardly facing shoulder means of the closure cap means is formed by radially projecting means of an inward axial extension of said closure cap means, said inward axial extension of said closure cap means being mounted for limited axial movement with respect to said sealing member so said axially outwardly facing shoulder means of the closure cap means does not engage said cap engaging portion of said sealing member until the closure means has been partially unthreaded from said external screw thread means of said container mouth.

* * * * *